US010246894B2

(12) United States Patent
Deloche et al.

(10) Patent No.: US 10,246,894 B2
(45) Date of Patent: Apr. 2, 2019

(54) ADJUSTABLE PUMPING POWER SWIMMING POOL CLEANING ROBOT

(71) Applicant: ZODIAC POOL CARE EUROPE, Paris (FR)

(72) Inventors: Rémi Deloche, Toulouse (FR); Philippe Pichon, Villeneuve de Riviere (FR)

(73) Assignee: ZODIAC POOL CARE EUROPE, Bron (FR)

( * ) Notice: Subject to any disclaimer, the term of this patent is extended or adjusted under 35 U.S.C. 154(b) by 605 days.

(21) Appl. No.: 14/440,448

(22) PCT Filed: Apr. 2, 2015

(86) PCT No.: PCT/FR2015/050870

§ 371 (c)(1),
(2) Date: May 4, 2015

(87) PCT Pub. No.: WO2015/150712

PCT Pub. Date: Oct. 8, 2015

(65) Prior Publication Data

US 2016/0298350 A1 Oct. 13, 2016

(30) Foreign Application Priority Data

Apr. 4, 2014 (FR) ..... 14 53005

(51) Int. Cl.
*E04H 4/16* (2006.01)

(52) U.S. Cl.
CPC ..... *E04H 4/1654* (2013.01)

(58) Field of Classification Search
CPC ..... E04H 4/16; E04H 4/1654; E04H 4/1663; E04H 4/1672
USPC ..... 15/1.7; 210/167.1, 167.15–167.17; 4/490
See application file for complete search history.

(56) References Cited

U.S. PATENT DOCUMENTS 6,412,133 B1 * 7/2002 Erlich ..... E04H 4/1654 15/1.7
2004/0260428 A1 * 12/2004 Hadari ..... E04H 4/1654 700/282

(Continued)

FOREIGN PATENT DOCUMENTS

| | | |
|---|---|---|
| FR | 2567552 | 1/1986 |
| WO | 2013060984 | 5/2013 |
| WO | 2015150712 A1 | 10/2015 |

OTHER PUBLICATIONS

International Patent Application No. PCT/FR2015/050870, International Search Report and Written Opinion, dated Jul. 9, 2015, 10 pages.

(Continued)

*Primary Examiner* — Mark Spisich
(74) *Attorney, Agent, or Firm* — Kilpatrick Townsend & Stockton LLP; Dean W. Russell

(57) ABSTRACT

Mobile swimming pool cleaners are detailed. Determination of adherence of the cleaners on lateral walls of swimming pools may occur in various ways, and power of pumps of the cleaners may be modified as results of the determinations. User input, further, may be provided indicating whether a cleaner has reached the waterline associated with a lateral wall and whether the cleaner is aspirating air into its inlet.

9 Claims, 3 Drawing Sheets

(56) References Cited

U.S. PATENT DOCUMENTS

| | | | | |
|---|---|---|---|---|
| 2008/0250581 | A1* | 10/2008 | Henkin | E04H 4/1654 15/1.7 |
| 2009/0301522 | A1* | 12/2009 | Abehasera | E04H 4/1654 134/18 |
| 2010/0306931 | A1* | 12/2010 | Garti | E04H 4/1654 15/1.7 |
| 2011/0020139 | A1* | 1/2011 | Pichon | E04H 4/1654 417/46 |
| 2013/0031729 | A1* | 2/2013 | Bernini | E04H 4/1654 15/1.7 |
| 2014/0015959 | A1* | 1/2014 | Durvasula | E04H 4/1654 348/114 |
| 2014/0096329 | A1* | 4/2014 | Garti | E04H 4/1654 15/1.7 |

OTHER PUBLICATIONS

French Patent Application No. FR1453005 , Preliminary Search Report, dated Dec. 2, 2014, 7 pages.
AU2015242489, "First Examination Report", dated Sep. 10, 2018, 3 pages.

* cited by examiner

ADJUSTABLE PUMPING POWER SWIMMING POOL CLEANING ROBOT

CROSS REFERENCE TO RELATED APPLICATIONS

This is a U.S. national phase under 35 U.S.C. § 371 of International Patent Application No. PCT/FR2015/050870, filed on Apr. 2, 2015, which claims priority to French Patent Application No. 14/53005 filed on Apr. 4, 2014, the entire contents of each of which are incorporated herein by reference.

The present invention relates to equipment for swimming pools. It more particularly concerns swimming pool cleaning apparatus capable of moving along inclined walls.

PREAMBLE AND PRIOR ART

The invention concerns apparatus for cleaning a surface immersed in a liquid, such as a surface formed by the walls of a pool, notably a swimming pool. It is notably a question of a mobile swimming pool cleaning robot. Such a robot performs said cleaning by travelling over the bottom and the walls of the pool of the swimming pool, brushing these walls, and aspirating the debris towards a filter. By debris, it is meant all the particles present in the pool, such as fragments of leaves, micro-algae, etc., this debris normally being deposited on the bottom of the pool or stuck to the lateral walls of the latter.

The robot is most usually supplied with energy by an electrical cable connecting the robot to an external control and power supply unit.

There are known, for example, in this field, the Applicant's patents FR 2 925 557 and 2 925 551 that are directed to immersed surface cleaning apparatuses with a demountable filter device. Such devices generally comprise a body, members for driving said body over the immersed surface, a filter chamber provided within the body and including a liquid inlet, a liquid outlet, and a liquid circulation hydraulic circuit between the inlet and the outlet via a filter device. Also known is the same Applicant's patent FR 2 954 380 that is directed to a swimming pool cleaning robot provided with an accelerometer for determining changes of attitude within the pool.

This apparatus uses automatic programmes for cleaning the bottom of the pool and possibly the lateral walls of the pool. Such a programme determines cleaning of the swimming pool in a predetermined time, for example one and a half hours. There is known for example the patent application FR 84 11609 that is directed to apparatus for automatically cleaning a surface immersed in a liquid, associated with a motor that is powered by electrical power supply means comprising sequential interruption means adapted to generate at a particular frequency interruptions of said electrical power supply for particular cut-off times.

The robot is generally removed from the water by the user at the end of the cycle or at regular intervals to be cleaned when the filter is too full of particles (leaves, micro-particles, etc.). There is further known the Applicant's patent application WO 2013/060984 describing self-propelled apparatus for cleaning immersed surfaces of a pool comprising, on activation of a return control button, a return setpoint sent to a programmed control device that is adapted to inhibit a cleaning programme and to command the driving device of the apparatus to drive it to the surface of the water, thus facilitating removal from the water by the user.

Moreover, in the prior art, depending on whether the cleaning robot succeeds correctly or not in climbing the walls of the swimming pool to clean them, it was known to add to it ballasts or floats to correct its behaviour, it is clear that this installation was not easy, required complementary means not available to the end user of the robot, and caused major variations in the behaviour of the robot in all of its manoeuvres.

The invention therefore aims to solve some of these problems. The invention moreover notably aims to provide swimming pool cleaning apparatus the energy consumption of which is low.

SUMMARY OF THE INVENTION

A first aspect of the invention consists in a swimming pool cleaning robot comprising:

- a body,
- at least one liquid circulation hydraulic circuit between at least one liquid inlet and at least one liquid outlet,
- means for driving and guiding said cleaning robot over a surface,
- means for generating a force for pressing the cleaning robot against said surface,
- means for determining the adherence of the cleaning robot to the surface,
- means for modifying the force for the pressing the cleaning robot against said surface, depending on the adherence determined.

The expression "swimming pool cleaning robot" means apparatus for cleaning an immersed surface, i.e. typically an apparatus mobile in or on the bottom of a swimming pool and adapted to filter debris deposited on a wall. Such apparatus is commonly referred to as a swimming pool cleaning robot when it includes means for automated management of movement on the bottom and over the walls of the swimming pool to cover all of the surface to be cleaned.

By an abuse of language, here «liquid» refers to the mixture of water and debris in suspension in the swimming pool or in the fluid circulation circuit in the cleaning apparatus.

In one particular embodiment the means for generating a force for pressing the robot comprises at least one liquid inlet located under the cleaning robot. It is clear that the terms under and over refer to a frame of reference linked to the position of the cleaning robot on a surface over which it travels. The bottom of the robot being situated between said robot and the wall travelled over and the top of the robot being the part of the robot farthest from the surface travelled over.

In one particular embodiment the means for generating a force for pressing the robot comprises at least one liquid outlet located above the cleaning robot.

To be more precise, in this case, at least one liquid outlet produces a jet of liquid approximately perpendicular to the bearing plane of the cleaning robot on its support surface.

In one particular embodiment the means for determining the adherence of the cleaning robot to the surface when this surface is a lateral wall of the swimming pool comprises determination of the level reached by the robot at the end of climbing a swimming pool lateral wall and/or determination that air is sucked in by said robot at the end of climbing.

In one particular embodiment the means for determining the adherence of the cleaning robot to the surface when this surface is a lateral wall of the swimming pool comprises determination of the time taken for the cleaning robot to descend to the bottom of the swimming pool and/or determination that air is sucked in by said robot at the end of climbing.

In one particular embodiment the means for modifying the force for pressing the cleaning robot comprises means for modifying the power of the pump. To be more precise, in this case, in one particular embodiment the power of the pump may be selected from a number of predetermined values. For example, the predetermined values are approximately the following values:

40 to 55%,
55 to 70%,
70 to 90%,
90 to 100% of the maximum power of the pump.

In accordance with another embodiment the predetermined values are approximately the following values:

30 to 50%,
50 to 70%,
70 to 90%,
90 to 100% of the maximum power of the pump.

The invention also concerns a cleaning robot comprising an external power supply and control unit, said external unit comprising means for displaying the selected pump power and control means for modifying this choice.

The invention also concerns immersed surface cleaning apparatus characterized by some or all of the features referred to above or hereinafter in combination.

DESCRIPTION OF THE FIGURES

The features and advantages of the invention will be better appreciated thanks to the following description, which sets out the features of the invention in one non-limiting example of application.

The description relates to the appended figures, in which.

DETAILED DESCRIPTION OF ONE EMBODIMENT OF THE INVENTION

The invention finds its application in a swimming pool technical environment, for example a family type swimming pool set into the ground.

In the present nonlimiting embodiment, immersed surface cleaning apparatus includes a cleaning unit, referred to hereinafter as a swimming pool cleaning robot, and a power supply and control unit for said swimming pool cleaning robot.

Figure 1:
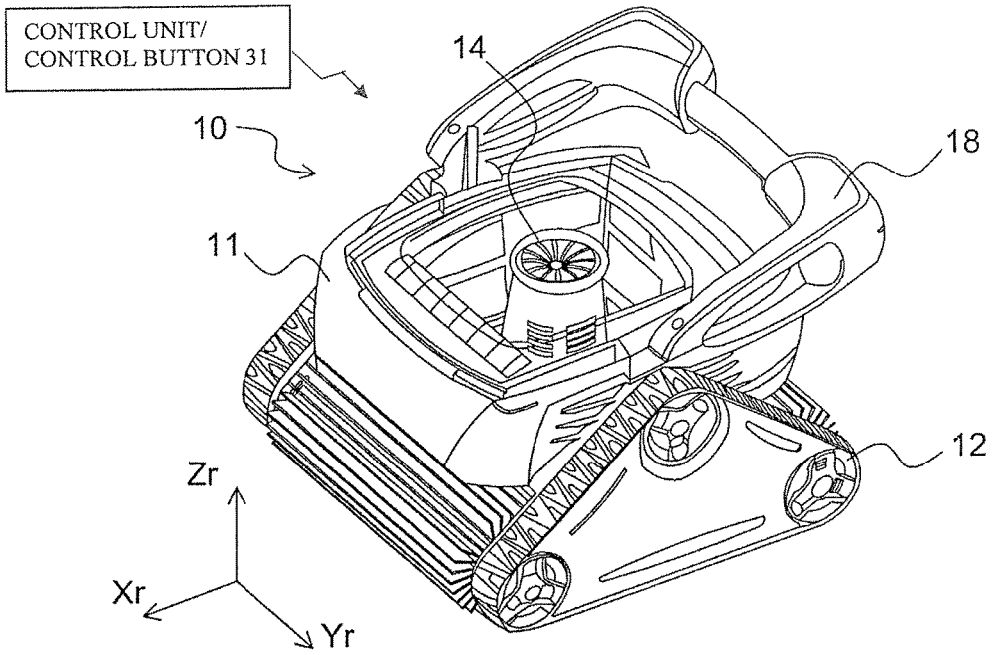
FIG. 1 is a perspective view of a swimming pool cleaning robot employing a filter system as described.
Figure 2:
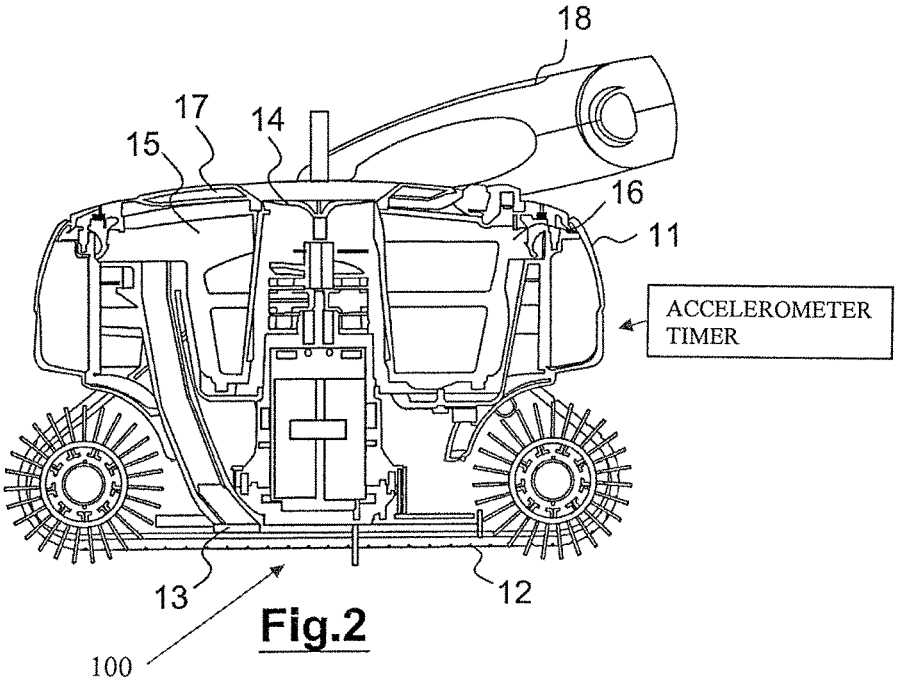
FIG. 2 is a view of the same apparatus in section on a vertical longitudinal plane.

One embodiment of the cleaning unit is represented by way of example in FIGS. 1 and 2.

The swimming pool cleaning robot 10 comprises a body 11 and a drive and guide device comprising members 12 for driving and guiding the body over an immersed surface. In the present non-limiting embodiment, these drive and guide members consist of wheels or caterpillar tracks disposed laterally of the body (see FIG. 1).

The swimming pool cleaning robot 10 further comprises a motor driving said drive and guide members, said motor being powered in the present embodiment via an on-board circuit card.

For the remainder of the description a frame of reference $X_rY_rZ_r$ relative to this cleaning robot 10 is defined in which:

- a longitudinal axis $X_r$ is defined as the axis of movement of the cleaning robot 10 when the movement wheels 12 are driven identically,
- a transverse axis $Y_r$ is defined as perpendicular to the longitudinal axis $X_r$, and situated in a plane parallel to the bearing plane of the movement wheels 12 of the cleaning robot 10, this lateral axis $Y_r$ therefore being parallel to the rotation axis of the wheels,
- a vertical axis $Z_r$ is defined as perpendicular to the other two axes, the bottom of the robot along this vertical axis $Z_r$ being situated between said robot and the wall travelled over and the top of the robot along this axis being the part of the robot farthest from the surface travelled over.

The concepts of front, rear, left, right, top, bottom, upper, lower, etc. relating to the cleaning robot are defined relative to this frame of reference $X_rY_rZ_r$.

The points of contact of said drive and guide members define with said immersed surface a guide plane on an immersed surface. Said guide plane, parallel to the plane formed by the longitudinal and transverse axes, is generally approximately tangential to the immersed surface at the point at which the apparatus is located. Said guide plane is approximately horizontal when the apparatus moves over a swimming pool bottom immersed surface, for example.

Throughout the text a «bottom» element is nearer the guide plane than a top element.

The swimming pool cleaning robot 10 includes a water fitter circuit including at least one liquid inlet 13 and one liquid outlet 14. In the present non-limiting embodiment, the liquid inlet 13 is situated at the base of the body 11 (in other words under the latter when the swimming pool cleaning robot 10 is placed in its normal operating position on the bottom of the swimming pool), i.e. immediately facing an immersed surface over which the swimming pool cleaning robot 10 moves in order to be able to suck up debris accumulated on said immersed surface. The liquid outlet 14 is on the top of the swimming pool cleaning robot 10.

In the present embodiment, the liquid outlet 14 is in a direction approximately perpendicular to the guide plane, i.e. vertical if the swimming pool cleaning robot 10 is resting on the bottom of the swimming pool, and horizontal if the cleaning apparatus is travelling over a vertical wall of the swimming pool.

The water filter circuit connects the liquid inlet 13 to the liquid outlet 14. The water filter circuit is adapted to be able to circulate liquid from the liquid inlet 13 to the liquid outlet 14. To this end the swimming pool cleaning robot 10 comprises a pump 100 (see FIG. 2) comprising a motor and an axial flow impeller, said motor driving the axial flow impeller in rotation, said axial flow impeller being disposed in the hydraulic circuit.

The apparatus comprises a filter chamber 15 in the hydraulic circuit between the liquid inlet 13 and the liquid outlet 14.

The filter chamber 15 comprises a filter basket 16 and a cover 17 forming the upper wall of the filter chamber 15.

The filter basket 16 is removable, i.e. it can be removed from and inserted into the body 11 of the cleaning robot 10. To this end, the body 11 of the cleaning robot 10 includes a housing in which the filter basket 16 may be mounted. The fact that the filter basket 16 is removable enables it to be emptied easily, notably without having to manipulate the entire robot 10.

In the present embodiment the swimming pool cleaning robot 10 is supplied with energy by means of a watertight flexible cable. In the present embodiment this flexible cable is attached to the upper part of the body of the swimming pool cleaning robot 10. This flexible cable is connected at its other end to the power supply unit (not shown in FIG. 1) disposed externally of the pool, this power supply unit being itself connected to the electrical mains supply.

Here the swimming pool cleaning robot 10 further includes a holding handle 18 adapted to enable the user to remove the robot from the water, notably when it is necessary to clean the filter.

The cleaning robot 10 moreover includes means for determining its attitude in the swimming pool at all times. To this end, the cleaning robot 10 includes for example at least one accelerometer of a type known in itself or «tilt» type means for detecting it going vertical or some other equivalent device known to the person skilled in the art. This accelerometer is used for example to determine that the cleaning robot is climbing a lateral wall of the swimming pool and not only to determine that the robot has reached the waterline as described in the prior art (WO 2013/060984).

The operating parameters of the cleaning robot 10, such as the type of cleaning cycle set by the user, for example, are adjusted by means of a user interface situated on the power supply and control unit and calculation means accommodated in this power supply and control unit.

Remember that such a cleaning robot frequently provides two cleaning cycles. In a first cycle, the robot travels over the bottom of the swimming pool in a pseudo-random manner, for example, and cleans the latter without climbing the lateral walls. In second cycle, the robot travels over the bottom of the swimming pool and also climbs the lateral walls so as to detach debris stuck thereto or concentrated at the waterline. In this second cycle, the robot climbs the lateral wall, emerges partially to scrub the waterline with its brush, tilts to move laterally along the wall, and dives by reversing its direction of movement to descend to the bottom again whilst further cleaning the wall.

In the present embodiment the user interface of the power supply and control unit includes means for controlling the power level of the pump when the cleaning robot is climbing a lateral wall of the swimming pool.

In fact, this pump causes, on the one hand, aspiration of water at the level of the water inlet 13 situated under the robot, and therefore closest to the surface against which the robot moves, and, on the other hand, evacuation of water via the water outlet 14, which is approximately perpendicular to the bearing plane of the robot and therefore the surface travelled over. These two phenomena of aspiration under the robot as evacuation of water under pressure on top of the robot determine pressing forces exerted on the robot towards the surface over which it is travelling. The adherence of the robot to the wall is increased by this, which facilitates its climbing. Such means for generating a pressing force differ from the prior art in which the swimming pool cleaning robots climb the walls of swimming pools by means for propelling the robot in a required direction and with a certain force enabling the progression of the robot along the walls.

Such a posteriori adjustment of the pressing force appears desirable if the conditions of adherence of the robot to the surface do not conform to the «standard» conditions for which the robot was factory set. The robot is in fact usually preset to a power of 60 to 80% of its maximum power when the accelerometer (or means for detecting it going vertical or to an angle of climb greater than a predetermined value) determines that the robot is climbing the lateral walls of the swimming pool.

In a first case, it may appear that the nature of the material forming the walls of the swimming pool is very different from the «standard» material for which the cleaning robot 10 has been preset. If has in fact been observed that the nature of the walls of swimming pools varies considerably, notably from one country to another, leading to different requirements for of the configuration of the pump settings according to the friction characteristics of the material forming these walls.

The surfaces may broadly be classified from the most smooth to the most rough, tile type surfaces being very slippery, followed by fiberglass or vinyl liner type surfaces. Surfaces of concrete or gravel or plastic particle aggregate being the roughest. It is moreover known that some swimming pools include waterlines materialized by a very slippery tiled area, which then has friction characteristics much different from the rest of the walls of the swimming pool.

It may then be desirable to increase the force pressing the robot onto the surface, when the wall is smoother, and, on the contrary, to reduce this pressing force when this wall is more adherent.

In a second case, the robot may include worn drive and guide means that reduce or modify its adherence to the surface of the walls of the swimming pool.

In another case, the pump itself may have non-nominal operating characteristics, with the effect of incorrect behaviour in climbing the lateral walls of the swimming pool.

In a further case, the swimming pool walls may be rendered particularly slippery by the presence of algae.

In all these cases, if is possible to determine a correct adjustment of the power of the pump of cleaning robot during its phases of climbing the walls of the swimming pool, whatever the nature of the surface forming these walls.

The adjustment is considered correct when the robot climbs to the waterline and cleans it without emerging from the pool to the point where the water inlet 13 reaches the open air and the cleaning robot 10 aspirates air into its filter circuit. Such aspiration, apart from being noisy, suddenly decreases the force pressing the robot onto the wall, and can cause it to separate from the wall and sink to the bottom of the pool, without cleaning the lateral wall as it descends.

In the present embodiment, it is assumed that the adjustment of the pump, when the accelerometer determines that the robot is travelling over an approximately horizontal surface, i.e. typically the bottom of the swimming pool, is independent of this adjustment of the pump power associated with the conditions of climbing the lateral walls. This pump adjustment under robot horizontal conditions is 100%, for example.

In the present embodiment the user interface accessible to the latter on the power supply and control unit includes a visual indicator of the pump power setting for climbing and a control button for modifying this pump power when climbing.

The visual indicator may consist of four horizontally aligned light-emitting diodes facing the user, thus forming a cursor. When the power of the pump is set to the minimum, for example, only the leftmost diode is lit. The other diodes are lit progressively from the left according to the power level selected.

Each pressing of the control button by the user changes the power cyclically between its possible settings, four successive pressings returning the adjustment to its initial value.

With the aim of carrying out this pump power adjustment associated with the conditions of climbing the lateral walls, the user determines visually to what level their cleaning robot 10 climbs the wall and if said robot sucks in air when it emerges, deduces from this a possible modification of the pump setting.

This setting then is stored for future cycles of use of the cleaning robot or until the next time the user changes the setting.

Figure 3:
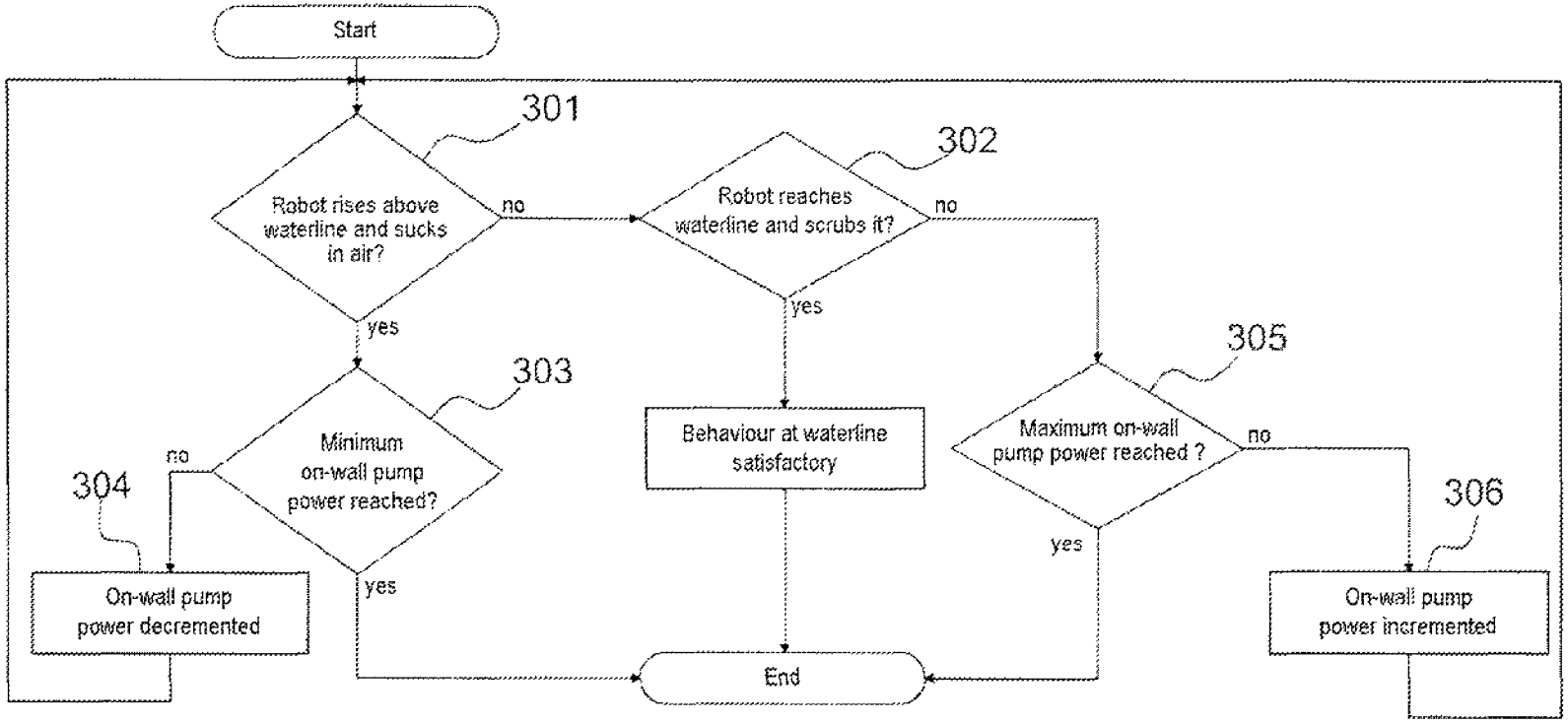
FIG. 3 is a flowchart of the adjustment of the on-wall pump power in the case of a manual adjustment example.

It is assumed here, by way of illustrative example, that the standard setting of the power of the pump is 60% when it is determined that the robot is travelling over a lateral wall of the swimming pool, which corresponds to a typical case for American type swimming pools (with relatively adherent walls). FIG. 3 illustrates the case of manual setting of the pump power.

It is also assumed that the pump has four settings accessible to the user: 50%, 60%, 80% and 100%. These values are naturally given here by way of example only and are not limiting on the invention in terms of the number of settings or the values thereof.

With the standard setting of 60% referred to above, the two leftmost diodes of the user interface are lit.

In this case, and in particular during the first use of their robot in their swimming pool, if the user determines visually that the cleaning robot 10 is not climbing above the waterline and is not sucking in air (step 301), they verify that the cleaning robot nevertheless reaches the waterline and brushes it (step 302). If this is the case, it means that the behaviour at the waterline is satisfactory. The setting of the pump is correct and no change is necessary.

On the other hand, if the cleaning robot 10 emerges from the water and sucks in air (step 301), the power must be reduced by one notch, and therefore here to 50% and to this end the user presses the control button three times, which is reflected visually by a return to only the leftmost diode being lit. More generally, if the minimum on-wall pump power has not been reached and the robot continues to behave in an unsatisfactory fashion (step 303), the on-wall pump power must be reduced (step 304).

Likewise, if the cleaning robot 10 climbs slowly and always remains below the waterline (step 302), the power must be increased, in this example to 80%. In this case, the user presses the control button 31 once, which is visually reflected by the three diodes on the left lighting.

More generally, if the maximum on-wall pump power has not been reached and the robot continues to be behave in an unsatisfactory fashion (step 305), it is necessary to increase the on-wall pump power (step 306).

If after adjusting the power to 80% the user finds that the robot still remains below the waterline at the end of its climb, they further increase the power to 100%, the four diodes of the visual indicator 31 then being lit.

It is clear that in all these cases the pump must be adjusted when the filter is empty, failing which the pressing power is restricted by the loss of pressure across said filter.

Figure 4:
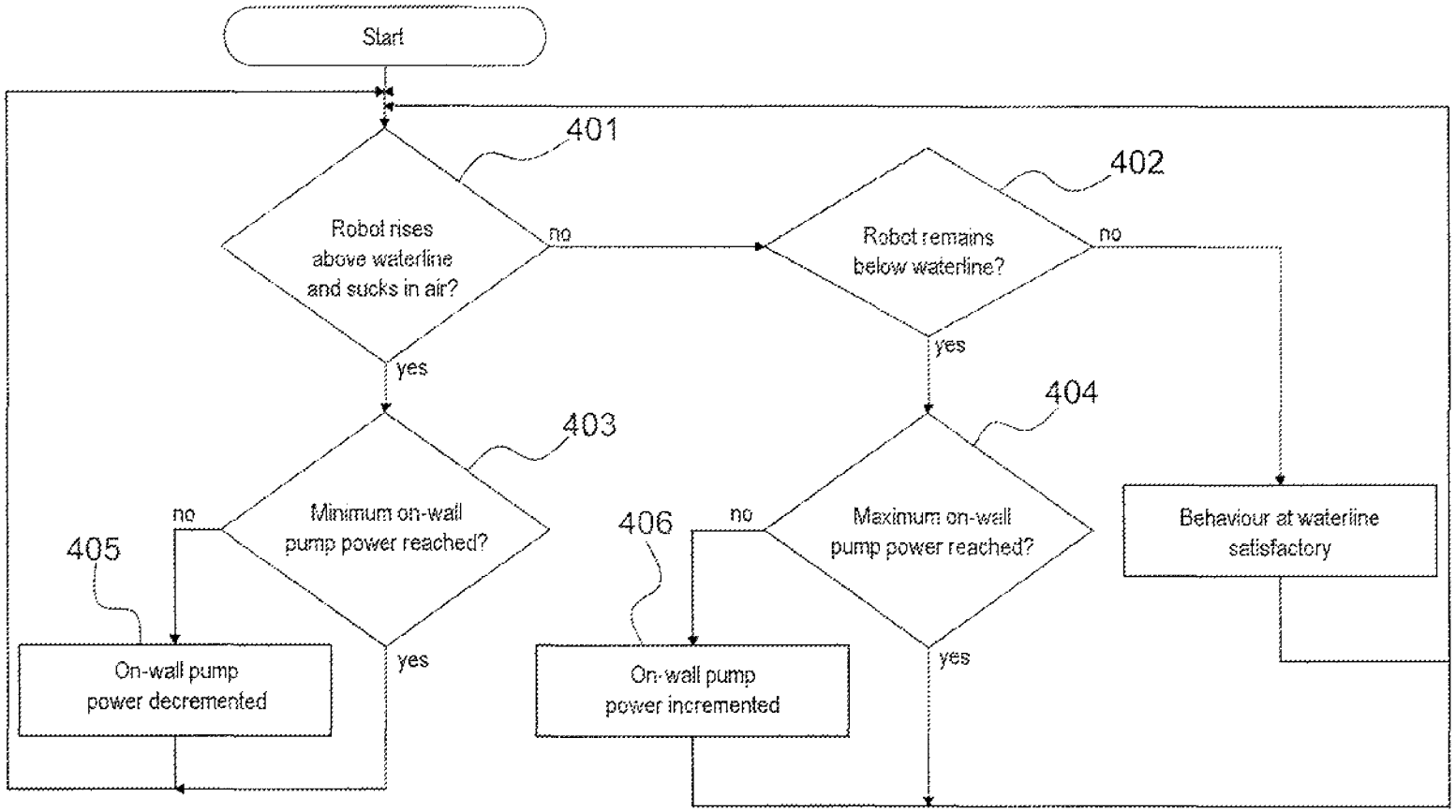
FIG. 4 is a flowchart of the adjustment of the on-wall pump power in the case of an automatic adjustment example.

In the case of automatic adjustments of the power of the pump (as shown by FIG. 4), in particular at the time of the first use of the robot in the swimming pool, if the cleaning robot 10 determines that if is not rising above the waterline and is not sucking in air (step 401) it verifies that it does not remain below the waterline (step 402). If this is the case, this means that the behaviour at the waterline is satisfactory. The setting of the pump is correct and no change is necessary.

On the other hand, if the cleaning robot 10 emerges from the water and sucks in air (step 401), if the minimum on-wall pump power has not been reached and the robot continues to behave in an unsatisfactory fashion (step 403), the robot decrements the on-wall pump power (step 405).

Likewise, if the cleaning robot 10 climbs slowly and always remains below the waterline (step 402), if the maximum on-wall pump power has not been reached and the robot continues to behave in an unsatisfactory fashion (step 404), the robot increases the on-wall pump power (step 408). In contrast to the prior art (WO 2013/080984) in which the accelerometer can determine the cleaning robot reaching the waterline only by detecting sudden accelerations of the robot, thus facilitating for the user the removal of the robot at the surface of the swimming pool, here the accelerometer is used in combination with a timer in order to determine the time between reversing the rotation direction of the driving means of the cleaning robot 10, which can occur at any height on the wall, and/or the entry of air into the hydraulic circuit of the cleaning robot 10 when it reaches the waterline, and the change of attitude of the cleaning robot 10 when if tilts from the wall towards the bottom of the swimming pool. This time reflects the height of the wall and the adherence of the cleaning robot 10. If this time is abnormally short, the pressing force and therefore the adherence of the cleaning robot 10 are increased.

Variants

In a variant embodiment, apparatus in accordance with the invention does not include its own pump and is connected to an external hydraulic circuit, for example outside a swimming pool, comprising a pump and creating suction at the end of a pipe connectable to the hydraulic circuit of the apparatus, for example at the level of its liquid outlet.

In another variant, a cleaning robot 10 includes means for determining the speed at which it climbs the lateral wall and infers automatically from this the level of adherence of the robot to this wall. These means may for example take the form of the timer that determines the time between the change of attitude of the robot (going vertical) and the moment at which the cleaning robot 10 emerges from the water (also detected by the accelerometer), the timer also determining the time for the robot to descend again to the bottom of the swimming pool. This descent time is relatively independent of the adherence of the robot to the lateral wall. It therefore makes it possible to estimate the height of the wall. Comparing the descent time and the climb time provides an image of the adherence of the wall that leads to an adjustment of the pressing force if this adherence of the wall is outside a predetermined range.

In this case, it is not necessary to call on the user to intervene, the robot adjusting its power when it is used for the first time or recurrently over time.

In a further variant, the robot determines in real time its speed at which it climbs a wall and adjusts its pump power accordingly.

The invention claimed is:

1. An apparatus for cleaning a swimming pool, comprising:

a. a body comprising an inlet and an outlet;

b. a debris filter interposed between the inlet and the outlet;

c. means for driving the body along a lateral wall of the swimming pool, the lateral wall extending above a waterline of the swimming pool;

d. means, comprising a pump, for generating a force for pressing the body against the lateral wall;

e. means for determining an adherence of the body to the lateral wall, such means being selected from the group consisting of (i) means for receiving input from a user indicating that air is being aspirated into the body through the inlet, (ii) an accelerometer used in combination with a timer, or (iii) means for receiving input from a user indicating that the body remains below the waterline; and f. means for modifying the pressing force, depending on the adherence determined, by modifying power of the pump.

2. The apparatus according to claim 1 in which the means for modifying the pressing force by modifying the power of the pump comprises means for adjusting the power of the pump to a value between 30-100% of a maximum power of the pump.

3. The apparatus according to claim 1 in which the body further comprises a base and the inlet is positioned at the base.

4. The apparatus according to claim 3 in which the body further comprises a top and the outlet is positioned on the top.

5. The apparatus according to claim 4 in which water of the swimming pool, having entered the body through the inlet and passed through the debris filter, is directed out of the body by the outlet in a direction approximately perpendicular to the lateral wall.

6. The apparatus according to claim 1 in which the means for receiving input from a user indicating that air is being aspirated into the body through the inlet comprises a control unit.

7. The apparatus according to claim 6 in which the control unit communicates with the means for modifying the power of the pump.

8. The apparatus according to claim 7 in which the control unit comprises a control button.

9. A method of cleaning a swimming pool, comprising:

a. providing an apparatus comprising (i) a body comprising an inlet and an outlet, (ii) a debris filter interposed between the inlet and the outlet, (iii) means for driving the body along a lateral wall of the swimming pool, the lateral wall extending above a waterline of the swimming pool, (iv) means, comprising a pump, for generating a force for pressing the body against the lateral wall, (v) means for determining an adherence of the body to the lateral wall, such means being selected from the group consisting of (A) means for receiving input from a user indicating that air is being aspirated into the body through the inlet, (B) an accelerometer used in combination with a timer, or (C) means for receiving input from a user indicating that the body remains below the waterline, and (vi) means for modifying the pressing force, depending on the adherence determined, by modifying power of the pump;

b. causing the apparatus to be driven along a surface of the swimming pool;

c. causing the pump to generate a force for pressing the body against the surface;

d. determining an adherence of the body to the lateral wall; and e. depending on the adherence determined, causing modification of the pressing force by causing modification of the power of the pump.

* * * * *